US005616003A

United States Patent [19]

Charbonnel et al.

[11] Patent Number: 5,616,003

[45] Date of Patent: Apr. 1, 1997

[54] TURBINE ENGINE EQUIPPED WITH MEANS FOR CONTROLLING THE PLAY BETWEEN THE ROTOR AND STATOR

[75] Inventors: Jean-Louis Charbonnel, Boissise le Roi; Daniel J. Marey, Soisy S/Seine; Fabrice Marois, Hericy; Gérard G. Miraucourt, Brie Comte Robert, all of France

[73] Assignee: Societe Nationale d'Etude et de Construction de Moteurs d'Aviation "SNECMA", Paris, France

[21] Appl. No.: 330,072

[22] Filed: Oct. 26, 1994

[30] Foreign Application Priority Data

Oct. 27, 1993 [FR] France ..... 93 12798

[51] Int. Cl.[6] ..... F03B 11/02

[52] U.S. Cl. ..... 415/209.3; 415/173.2; 415/209.2; 415/173.3

[58] Field of Search ..... 415/173.1, 173.3, 415/139, 209.3, 209.2

[56] References Cited

U.S. PATENT DOCUMENTS

| | | | |
|---|---|---|---|
| 2,928,586 | 3/1960 | Hart | 415/209.3 |
| 4,131,388 | 12/1978 | Brodell . | |
| 4,728,257 | 3/1988 | Handschuh . | |
| 5,288,206 | 2/1994 | Bromann et al. | 415/209.3 |
| 5,320,487 | 6/1994 | Walker et al. | 415/209.2 |

FOREIGN PATENT DOCUMENTS

| | | | |
|---|---|---|---|
| 0589736 | 3/1994 | European Pat. Off. | 415/209.2 |
| 0975897 | 3/1951 | France . | |
| 1301686 | 7/1962 | France . | |
| 1339482 | 8/1963 | France . | |
| 2444801 | 7/1980 | France . | |
| 2482661 | 11/1981 | France . | |
| 2482662 | 11/1981 | France . | |
| 2516980 | 5/1983 | France . | |
| 2683851 | 6/1993 | France . | |
| 0936900 | 12/1995 | Germany | 415/209.3 |
| 0137933 | 7/1950 | United Kingdom | 415/209.3 |
| 2115487 | 9/1983 | United Kingdom . | |

*Primary Examiner*—Edward K. Look
*Assistant Examiner*—Mark Sgantzos
*Attorney, Agent, or Firm*—Oblon, Spivak, McClelland, Maier & Neustadt, P.C.

[57] ABSTRACT

A turbine engine includes a ferrule formed of a plurality of ferrule elements in the shape of circular sectors, each bearing on one internal face thereof fixed vanes and a circular housing surrounding the ferrule. The turbine has a support ring including a plurality of circular ring sectors each secured to the housing and having a U-shaped section whose opening is directed towards the ferrule, each ferrule element includes a hooking mechanism (9*a*) to be introduced into the opening of at least one ring sector so as to integrally connect the ring sector and the ferrule element.

15 Claims, 8 Drawing Sheets

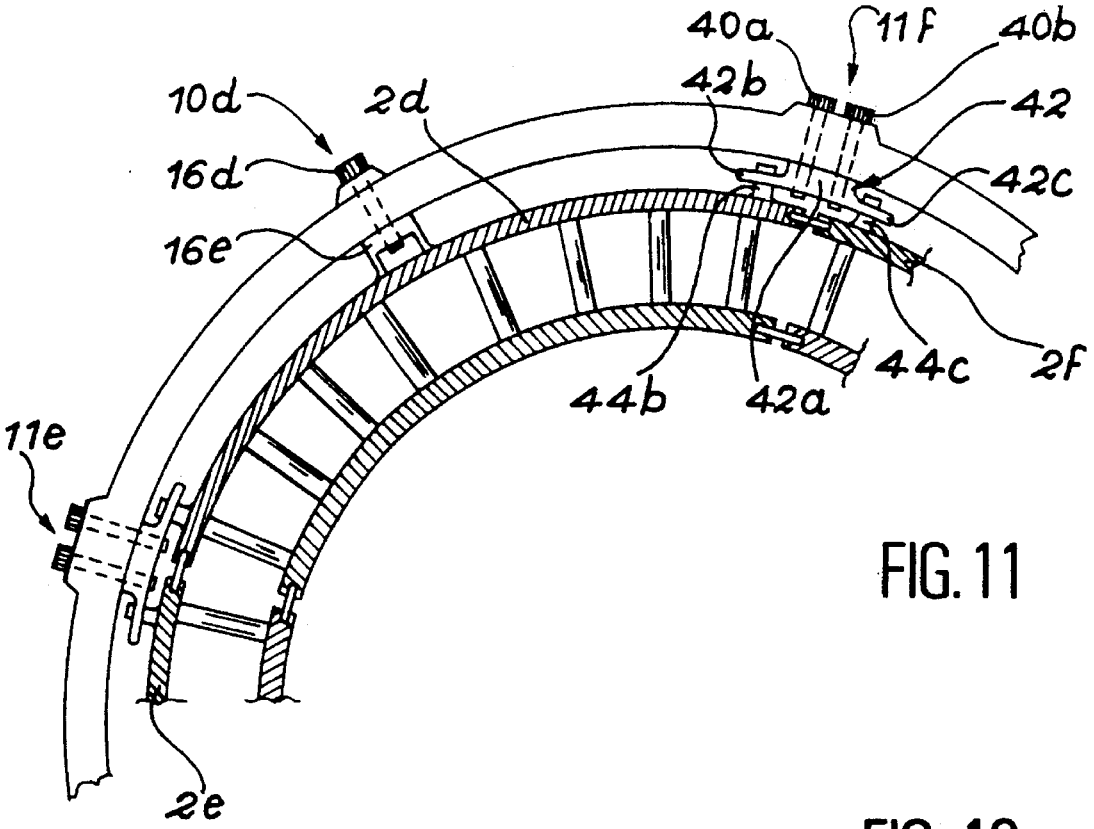
FIG. 11
FIG. 12
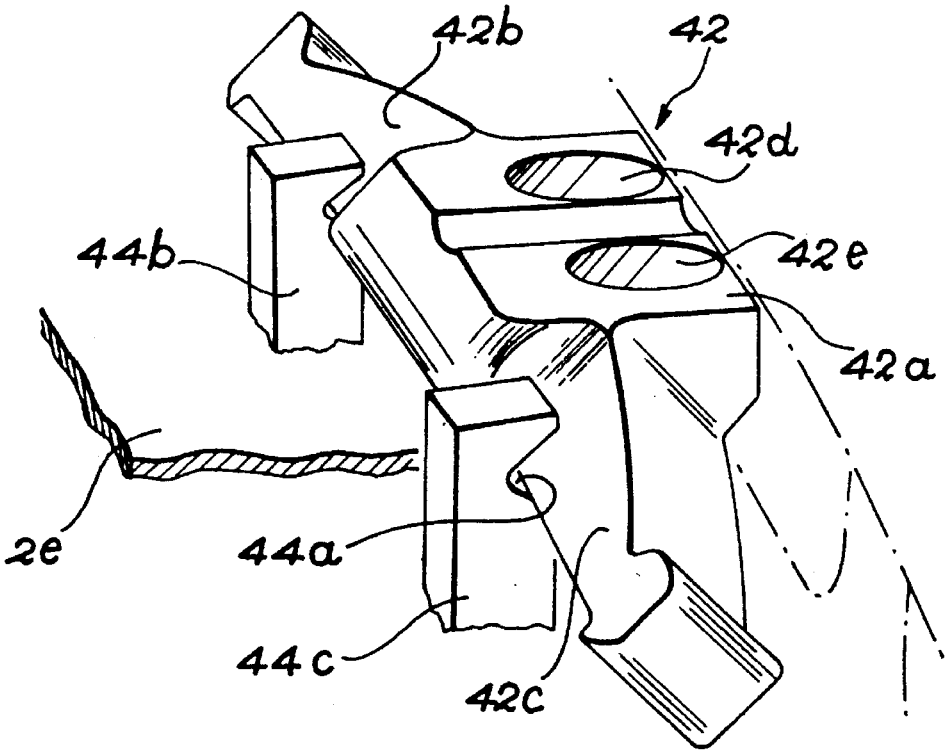

TURBINE ENGINE EQUIPPED WITH MEANS FOR CONTROLLING THE PLAY BETWEEN THE ROTOR AND STATOR

DISCUSSION OF THE BACKGROUND

1. Field of the Invention

The present invention concerns a turbine engine comprising means for controlling the play between the rotor and stator and more particularly between the stator and top of the mobile vanes of the rotor.

2. Background of the Discussion

The regular temperature rises to which a turbine engine is subjected generally provoke heat expansions which are important to control in order to prevent in particular gas leaks occuring between the rotor and structure of the stator which surrounds it, as well as to prevent yield losses resulting from these gas leaks.

Aircraft engines (especially those used for the propulsion of jet planes) need to be able to function in conditions able to vary rapidly. These variations in operating conditions may include racing of the cold rotor, striking of the gas control lever, a racing of the hot rotor or all other operating conditions familiar to operators in this particular field.

It is also necessary to obtain constant play between the ferrule of the stator and the rotor during variable functionings, such as those listed above. In particular, it is important that the radial play between the external ends of the mobile vanes of the rotor and the internal ferrule of the stator bearing the fixed vanes for rectifying the flow of air between the mobile vanes are as constant as possible.

Now, the obtaining of these constant plays is relatively difficult owing to the fact of firstly the expansion and variable mechanical construction of the rotor under the effect of speed variations, and secondly the heat rise between the stator and the rotor due to a significant but essential difference of temperature delays.

Various means exist to limit the consequences of wear of the ferrule of the stator due to an expansion of the mobile vanes exceeding expansion during "normal" functioning. One first method consists of producing the ferrules with a coating of a soft material at the location in front of which the mobile vanes pass. Thus, the possible rubbing of the end of the mobile vanes which could occur during a higher expansion of these vanes would provoke a wear of the coating and a shaping of the stator at this location.

Another method able to obtain a satisfactory result consists of producing the stator in such a way so that it is possible to have gas circulate there, this gas being taken from another part of the engine and having a specific temperature and flowrate which produce at will heating or cooling able to adjust the expansions of the ferrule and thus its play with the mobile vanes.

This communication of air at a variable temperature to the structure of the rectifier support, by virtue of a variation of the expansion and contraction speed of the structure, is able to accomodate various engine operating conditions.

In order to ensure the expansion and contraction of the structure as regards the entire circumference of the housing, the latter is generally formed of a single piece, this therefore concerning a housing with a circumference of 360°.

The documents FR-2 683 851, FR-2 516 980 and FR-2 482 661 describe turbine engines whose stators comprise double skin housings extending around rotors over a complete circumference, the heating or cooling air circulating between the two skins of the housing. According to these turbine engines, the ferrule elements (or ferrule sectors) are directly linked to the housing. Also, at the time of expansions or contractions of the housing, the ferrule elements may undergo movements which adversely affect the circularity of the structure.

Finally, so as to maintain perfect circularity of the ferrule elements and ensure an immediate reaction of the structure on expansion and contraction, means are used to adapt the ferrule elements to the housing. GB-2 115 487 describes stator rings dove tail nested in supports. The document FR-2 482 662 describes a segmented stator ring pierced with orifices.

None of these adaptation means ensures a flexible link of the ferrule elements with respect to the housing.

SUMMARY OF THE INVENTION

The present invention seeks to overcome these drawbacks. To this end, it concerns a turbine engine comprising a stator with a housing having a circumference of 360° and the ferrule elements being linked by means of a fixed point and sliding supports providing the ferrule with circumferential flexibility.

According to a first embodiment of the invention, the turbine engine comprises a support ring housed between the housing and the ferrule and including a plurality of circular ring sectors each secured to the housing by a fixed point device and sliding support means and having a U-shaped section whose opening is directed towards the ferrule, each ferrule element comprising hooking means able to be introduced into the opening of at least one ring sector so as to render integral said ring sector and the ferrule element.

According to this embodiment, each ring sector comprises one upstream wing and one downstream wing, each of said upstream and downstream wings including first recesses radially open towards the ferrule so as to provide the ring sector with circumferential flexibility. In addition, the upstream wing comprises second recesses.

For this embodiment, the turbine engine comprises support chucking means on both sides of each ring sector so as to ensure said ring sector is rendered integral with the hooking device of the ferrule element.

These chucking means comprise a screw and a conical nut introduced inside the ring sector and able to be moved apart when introducing the screw, the base of said nut then being in support on the internal faces of the ring sector.

The hooking means of each ferrule element, together with the ends of the upstream and downstream wings of the ring sector into which it is introduced, constitute a dovetail assembly.

According to this embodiment, each fixed point device comprises a nut/screw system ensuring the integral rendering without play of a ring sector with the housing, the nut being introduced inside the ring via the second recess and disposed on support on an internal face of the core of the ring sector.

The screw may possibly be introduced into the ring sector with an inclination of about 45° with respect to a radial direction. According to another example, it may be introduced radially into the ring sector, the nut then having a conical shape whose base is directed towards the ferrule.

According to this embodiment, each sliding support device comprises:

a screw introduced into the ring sector via an opening made in the core of said ring sector;

a sole surmounted by a projection which is pierced with a hole and has a threaded pitch so as to receive said screw and which traverses the opening of the core in order to be in contact with the housing; and two support pieces disposed on both sides of the hole of the sole and secured to the ring sector so as to permit sliding of the sole on the support pieces.

The screw is then introduced into the ring sector with a longitudinal inclination with an angle α, and the support pieces comprise a slanted surface with an angle α with respect to a radial direction.

Advantageously, the first recesses of the front wing are closed by sealing plates. Around the first recesses, each ring sector comprises grooves in which the sealing plates are nested and positioned.

Each upstream wing of a ring sector may comprise at one end a prologation bracket and at the other end a machining ensuring said ring sector is nested and covered in the adjacent ring sectors.

According to a second embodiment of the invention, each sliding support device is horseback-positioned on two ferrule elements so as to ensure they are integral with each other.

According to this embodiment, each sliding support device comprises:

two screws (40*a*, 40*b*) traversing the housing;

a sole (42*a*) situated at the junction point of the two ferrule elements between the housing and said ferrule elements, said sole being pierced with two threaded holes (42*d*, 42*e*) so as to receive the two screws and comprising sliding brackets (42*b*, 42*c*) disposed on both sides of the holes;

two support pieces (44*b*, 44*c*) situated on both sides of the holes of the sole and each secured to one of the ferrule elements so as to slide along the sliding brackets of the sole.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 11 represents a partial view of the means for controlling the plays between the rotor and stator conforming to the second embodiment of the invention;

FIG. 12 shows a perspective view of a sliding point conforming to the embodiment of FIG. 11, and FIGS. 13 and 14 represent a partial axial section of a sliding point of FIG. 11 according to two mounting methods.

DETAILED DESCRIPTION OF THE PREFERRED EMBODIMENTS

Figure 1:
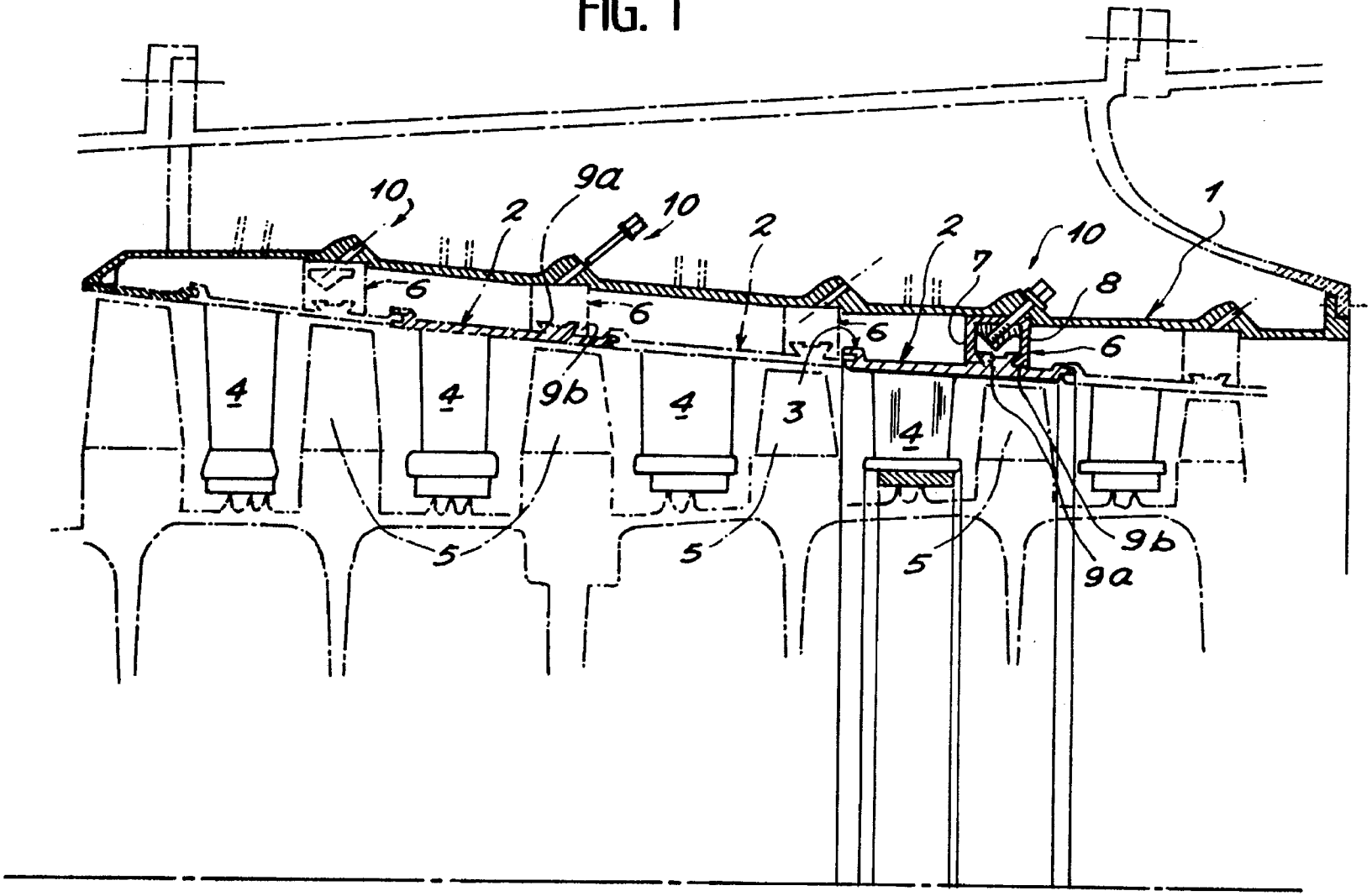
FIG. 1 shows a high pressure compressor equipped with means for controlling the plays between the rotor and stator and conforming to the first embodiment of the invention.

FIG. 1 shows an axial section of a high pressure compressor having an external housing 1 with a circumference of 360° and means for controlling the clearances conforming to the first embodiment of the invention. This housing 1 comprises two concentric slightly conical casings (or two skins) separated by a volume (shown by the hatching on FIG. 1) in which the heating or cooling air circulates. This two-skin housing is of the type described in the document FR-2 683 851 mentioned earlier and thus shall not be described here in detail.

This housing 1 surrounds a plurality of ferrule elements 2 which are approximately conical. These ferrule elements 2 are disposed end-to-end and assembled by nesting joints 3 so as to form a single continuous ferrule approximately parallel to the housing 1.

Each ferrule element 2 bears a stage of stator fixed vanes 4, also known as a rectifying stage. A stage of mobile rotor vanes 5 extends between each pair of stages of fixed vanes 4.

FIG. 1 also shows the rings 6 according to the first embodiment of the invention, these rings allowing for significant movements of the ferrule elements 2 according to the expansions and contractions of the housing 1. These rings 6 each comprise a plurality of ring sectors disposed end-to-end and nested inside one another so as to embody continuous rings.

This FIG. 1 shows the section of a ring 6. As can be seen on the figure, each ring 6 has a U-shaped section, the open side of the U being directed towards the ferrule 2.

Each ferrule element 2 comprises on its external face, that is on the face not bearing the fixed vanes 4, means 9*a*, 9*b* for hooking the ring 6. According to a preferred embodiment of the invention, these hooking means consist of a dovetail heel 9*a* able to be introduced into the opening of the ring 6. The ends of the upstream 7 and downstream 8 wings of the ring 6 form a notch 9*b* able to receive the heel 9*a*. The notch 9*b* and the heel 9*a* thus form a dovetail assembly. Chucking means (not shown on FIG. 1) ensure a chucking on both sides of the upstream 7 and downstream 8 wings of the ring 6 so as to ensure that said ring 6 is rendered integral with the ferrule 2.

Each ring sector 6 is secured to the housing with the aid of a fixed point 10 to be described in greater detail via the following figures. Each ring sector is in addition secured to the housing by means of sliding supports (not shown on FIG. 1 but described in more detail in the continuation of the description).

FIG. 2 and FIGS. 3 to 10 show details of the elements constituting the first embodiment of the controlling means shown on FIG. 1.

Figure 2:
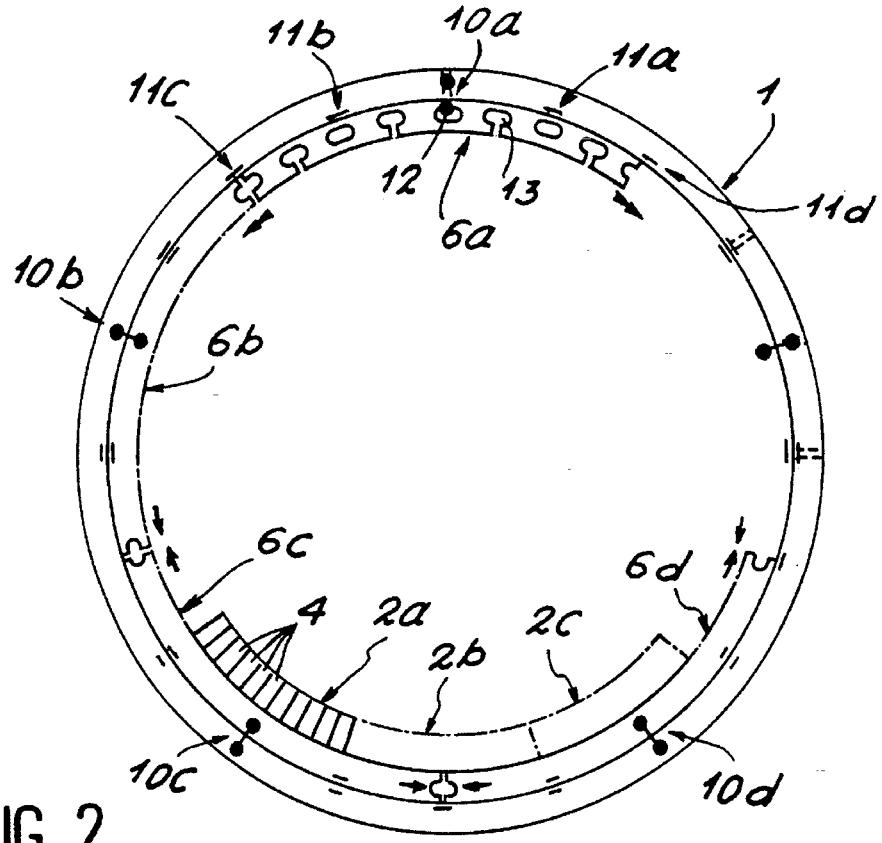
FIG. 2 represents a diametral section of the turbine engine according to the first embodiment showing the angular distribution of the ferrule elements and the ring sectors inside the housing.

FIG. 2 shows the angular distribution of the ferrule elements 2 and the ring sectors 6 inside the housing 1. The ferrule thus comprises a plurality of ferrule elements, three of said elements being shown on FIG. 2 with the references 2*a*, 2*b* and 2*c*. Similarly, the ring 6 comprises a plurality of ring sectors, four of the latter being shown on this figure and bearing the references 6*a*, 6*b*, 6*c* and 6*d*. According to the embodiment shown on this figure, each ring sector has a size equivalent to about two ferrule elements.

However, it ought to be mentioned that the size of a ferrule element and the size of a ring sector are entirely independent of each other.

Each ring sector 6*a*, 6*b*, 6*c* and 6*d* is linked to the housing 1 by a fixed point respectively marked 10*a*, 10*b*, 10*c* and 10*d*. Each ring sector 6*a*, 6*b*, 6C and 6*d* is in addition linked to the housing by sliding supports. There are four sliding supports per ring sector and are distributed as follows:

two sliding supports distributed on both sides of the fixed point; and two sliding supports each situated at one end of a ring sector.

According to the embodiment represented on FIG. 2, the ring sector 6*a* comprises two sliding supports 11*a* and 11*b* on both sides of the fixed point 10*a* and two sliding supports 11*c* and 11*d* at each of its ends.

For each ring sector, all these sliding supports ensure an immediate circumferential movement (shown by the arrows on FIG. 2) of the ring sector and thus of the ferrule elements connected to this ring sector with respect to the movement of the housing.

Furthermore, diagrammaticaly shown on FIG. 2 are the recesses of the upstream wing of the ring sector 6*a*. Each ring sector in fact comprises a plurality of recesses, namely the recesses 12 solely on the upstream wing and the recesses 13 on the upstream wing and downstream wing, these recesses providing the ring sector with circumferential flexibility. The ring sectors 6*a*, 6*b*, . . . are assembled with the adjacent ring sectors at the level of the center of a recess 12.

Figure 3:
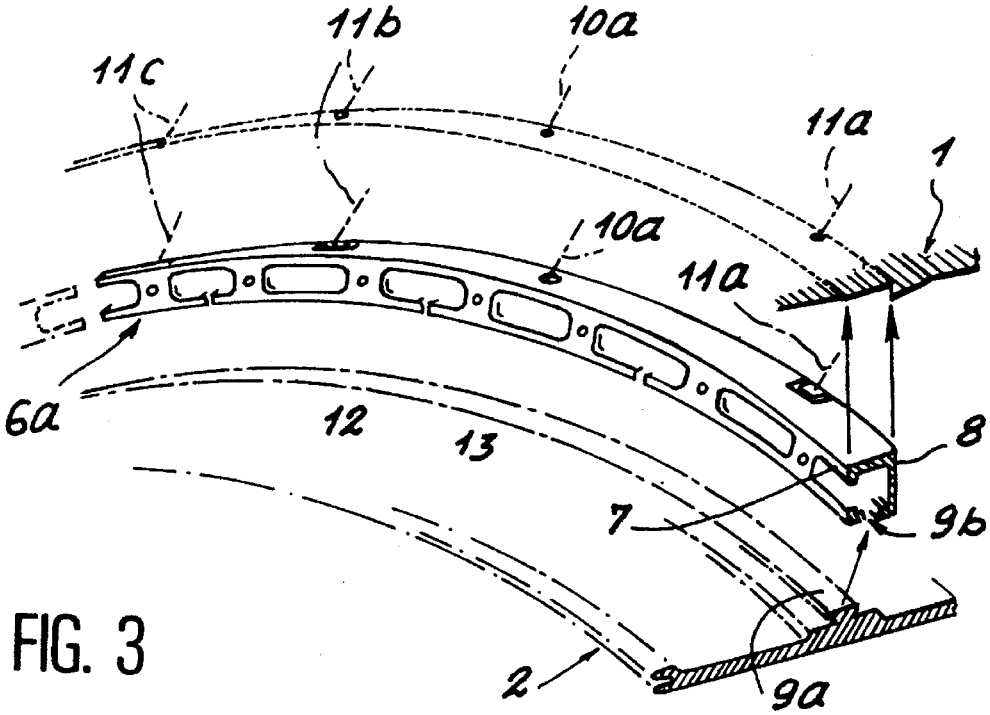
FIG. 3 shows a perspective view of a ring sector of FIG. 2.

FIG. 3 shows a perspective view of the ring sector 6*a* of FIG. 2. This figure thus shows the ring sector 6*a* cut at the level of a recess 13, the housing 1 to which the ring sector 6*a* is secured, and the ferrule 2 with its dovetail heel 9*a* around which the dovetail ends 9*b* of the upstream 7 and downstream 8 wings are nested. More specifically, the ring sector 6*a* is connected to the housing 1 by means of the fixed point 10*a* and several sliding supports, three of the latter being shown or this figure, namely 11*a*, 11*b* and 11*c*.

This figure shows the recesses 12 of the upstream wing, as well as the recesses 13 with their radial slit, these recesses 13 being also present on the downstream wing 8 but not visible in this perspective view of the ring sector 6*a*.

Figure 4A:
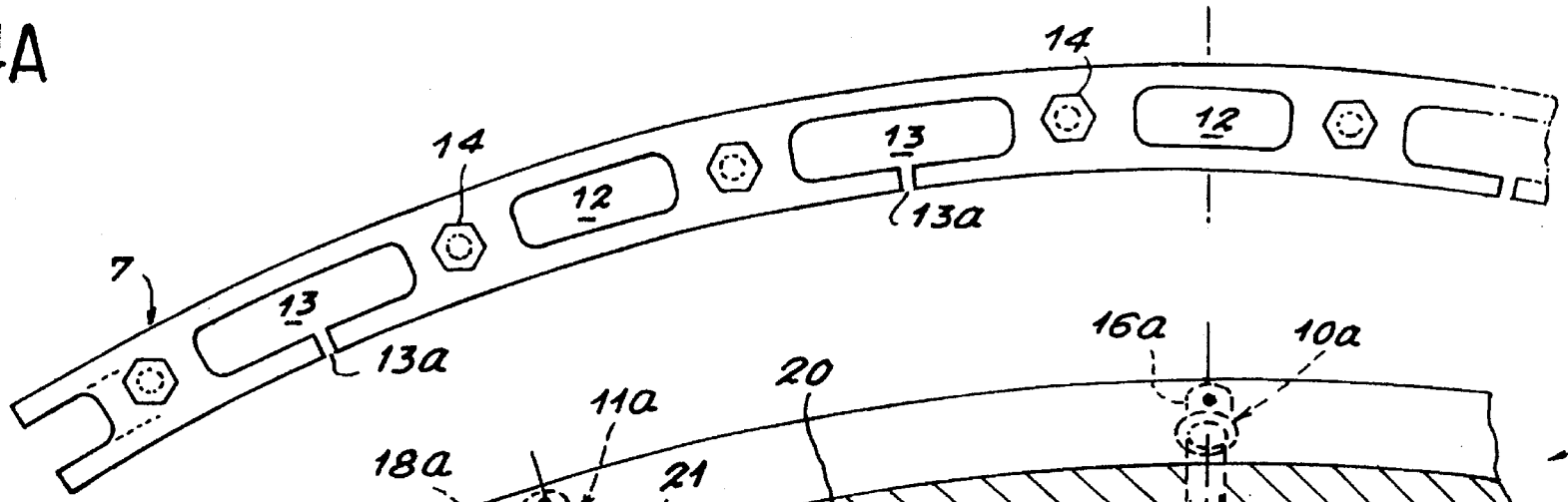
FIGS. 4A and 4B respectively represent a partial view of the upstream wing and downstream wing of a ring sector of FIG. 2.
Figure 4B:
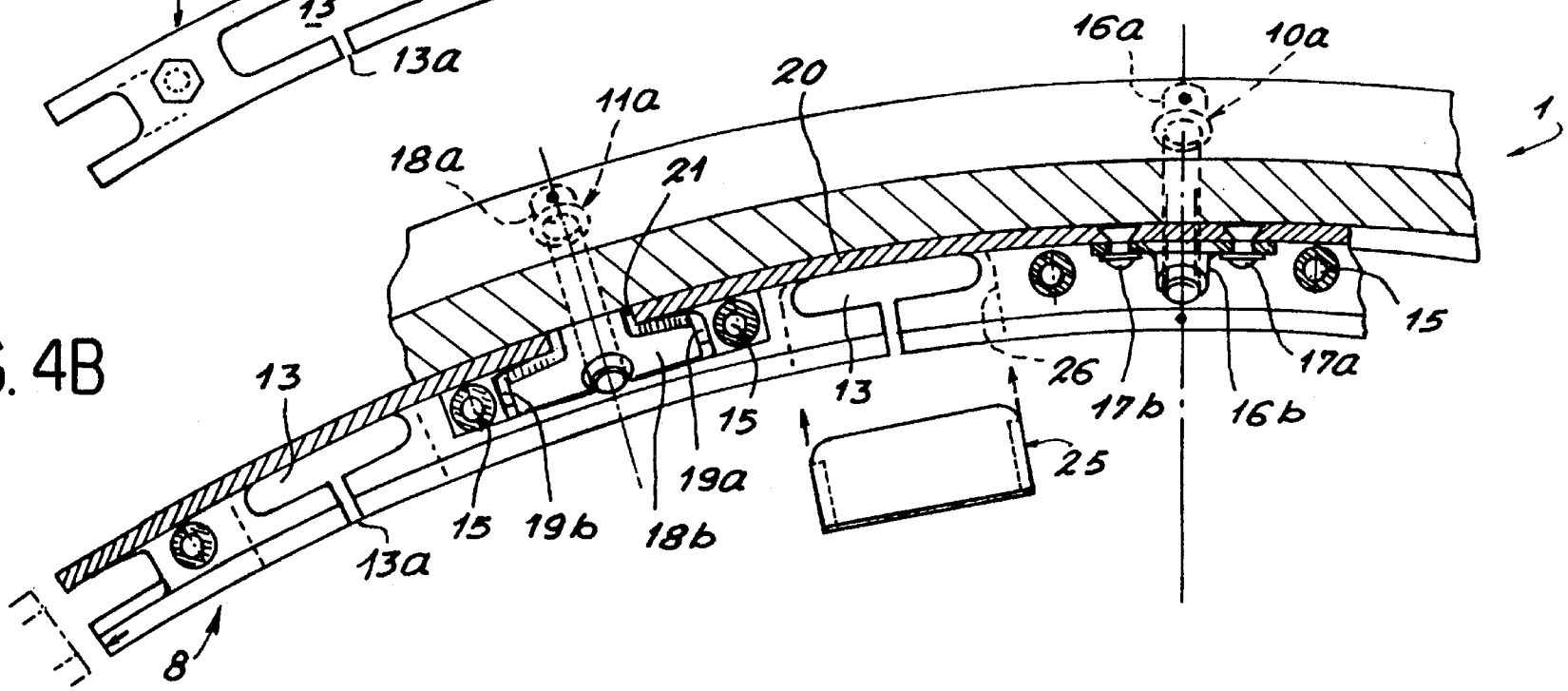

Also shown in FIG. 4A is a portion of the upstream wing 7 of the ring sector 6*a* and, in FIG. 4B, a portion of the downstream wing 8 of this same ring sector 6*a*.

In more detail, FIG. 4A shows the outer face of the upstream wing 7 of the ring sector 6*a*. This shows the recesses 12 of the upstream wing 7 and the recesses 13 of this same upstream wing 7. As explained earlier, these recesses 13 comprise a radial opening 13*a* or radial slit, starting from the internal portion of the ring sector (that is, the portion with the smallest diameter) and end in the recess 13. These radial slits provide the ring 6 with circumferential flexibility.

The recesses embodied in the upstream wing 7 make it possible to reduce the amount of material required for the embodiment of this ring; as a result, the ring is lightened. In addition, these recesses 12 ensure a reduction in the heat exchanges between the ambient environment and the ring 6.

FIG. 4A also shows the nuts 14 of the chucking means.

FIG. 4B shows the internal face of the downstream wing 8 of the ring sector 6*a*. This downstream wing 8 comprises the recesses 13 with their radial slits 13*a* and the screws 15 which completely traverse the ring sector and are fixed in the nuts 14 of the upstream wing 7. Each screw 15 associated with a nut 14 constitutes the chucking means which ensure the grasping of the ring sector around the dovetail heel of the ferrule.

FIG. 4B also includes the screws of the fixed point 10*a* and of the sliding support 11*a*. These screws are shown by dots as they are not visible on the internal face of the downstream wing 8. The screw 16*a* of the fixed point 10*a* is inserted inside the housing 1 and the downstream wing 8 is fixed in the nut 16*b* which is in contact with the internal face of the downstream wing 8. This nut 16*b* is secured to the downstream wing 8 with the aid of two rivets 17*a* and 17*b*.

This fixed point shall be described in greater detail in the rest of the description.

The sliding support 11*a* is also shown in FIG. 4B. The screw 18*a* of the sliding support is inserted in a sole 18*b* surmounted by a projection pierced with a hole on the wall of which a thread pitch has been made. This sole 18*b* is in support on support pieces 19*a* and 19*b* disposed on both sides of said hole of the sole 18*b*. These support pieces 19*a* and 19*b* are traversed by the screws 15 which renders integral said support pieces on the downstream wing 8. In addition, an opening 21 is made in the core 20 of the ring sector; the sole 18*b*, together with the projection which surmounts it, has a pickaxe shape able to move partly into the opening 21 of the core 20 of the ring sector 6*a* so as to be in direct contact with the internal wall of the housing 1. The lateral sections of the sole 18*b* are thus able to slide on these support pieces 19*a* and 19*b*, thus creating a circumferential play of the ring segment 6*a* with respect to the housing 1.

According to one embodiment, this sole 18*b* is a double bearing surface nut.

According to one preferred embodiment of the invention, the support pieces 19*a* and 19*b* form an angle of about 45° with respect to the downstream wing 8 so as to ensure improved sliding of the sole 18*b*.

This sliding support shall be described in greater detail with reference to FIGS. 8 and 9 of the description.

In addition, FIG. 4B shows a sealing plate 25 able to be introduced into grooves (or slits) machined around the recesses 13 of the downstream wing 8. These grooves 26 are shown by the dots on the figure as they are embodied on the outer face of the downstream wing 8. The sealing plate 25 comprises returns (shown by dots) able to enter the grooves 26 so as to ensure the positioning and nesting of said sealing plates 25 in the downstream wing 8. The purpose of the positioning of these sealing plates in front of the recesses 13 of the downstream wing 8 of the ring sector 6*a* is to prevent any gas being reintroduced from downstream towards upstream of the ring.

Figure 7:
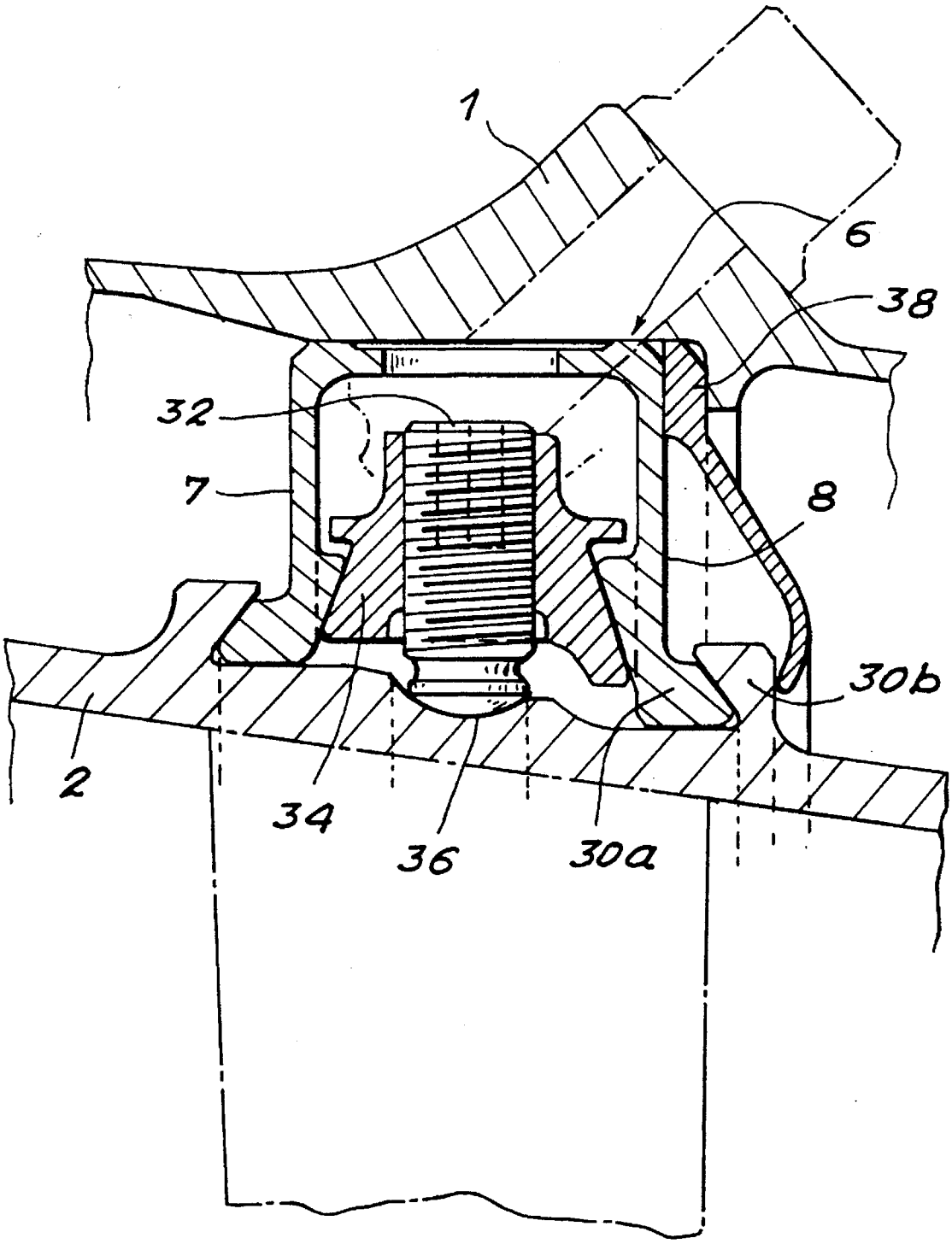
FIG. 7 shows an axial section of a variant of the chucking means and the sealing means of the first embodiment.

According to another embodiment of the invention, as shown on FIG. 7, the imperviousness of the downstream wing of each ring sector is embodied with the aid of a gasket 38 in support on the downstream portion of the dovetail assembly.

Figure 5:
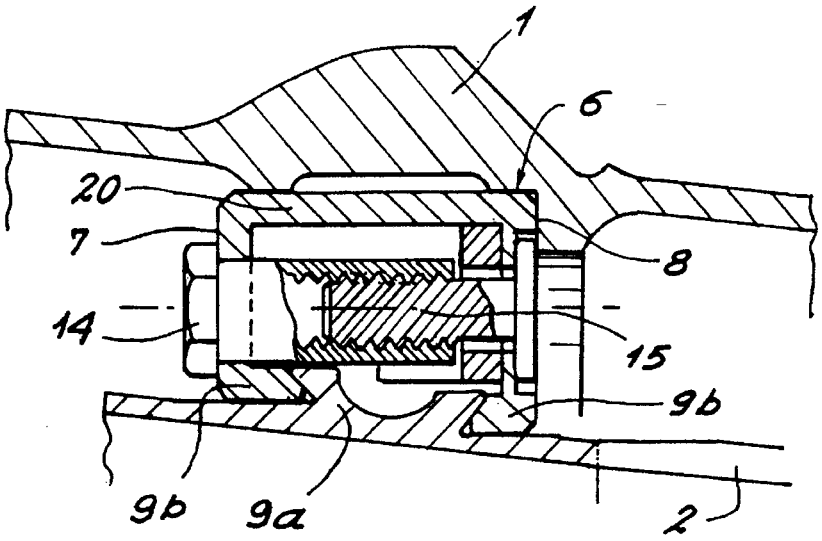
FIG. 5 shows according to an axial section the chucking means ensuring the integral rendering of the ring sectors and ferrule elements in accordance with the first embodiment.

FIG. 5 shows a section of the chucking means. As described earlier in brief, these chucking means comprise a screw 15 introduced into the downstream wing 8 of the ring 6 and completely traversing said ring. This screw 15 is fixed in a nut 14 in support on the outer face of the upstream wing 7. These chucking means thus are able to compress the notch 9*b* embodied by the wings 7 and 8 of the ring 6 against the dovetail heel 9*a* of the ferrule 2.

Figure 6:
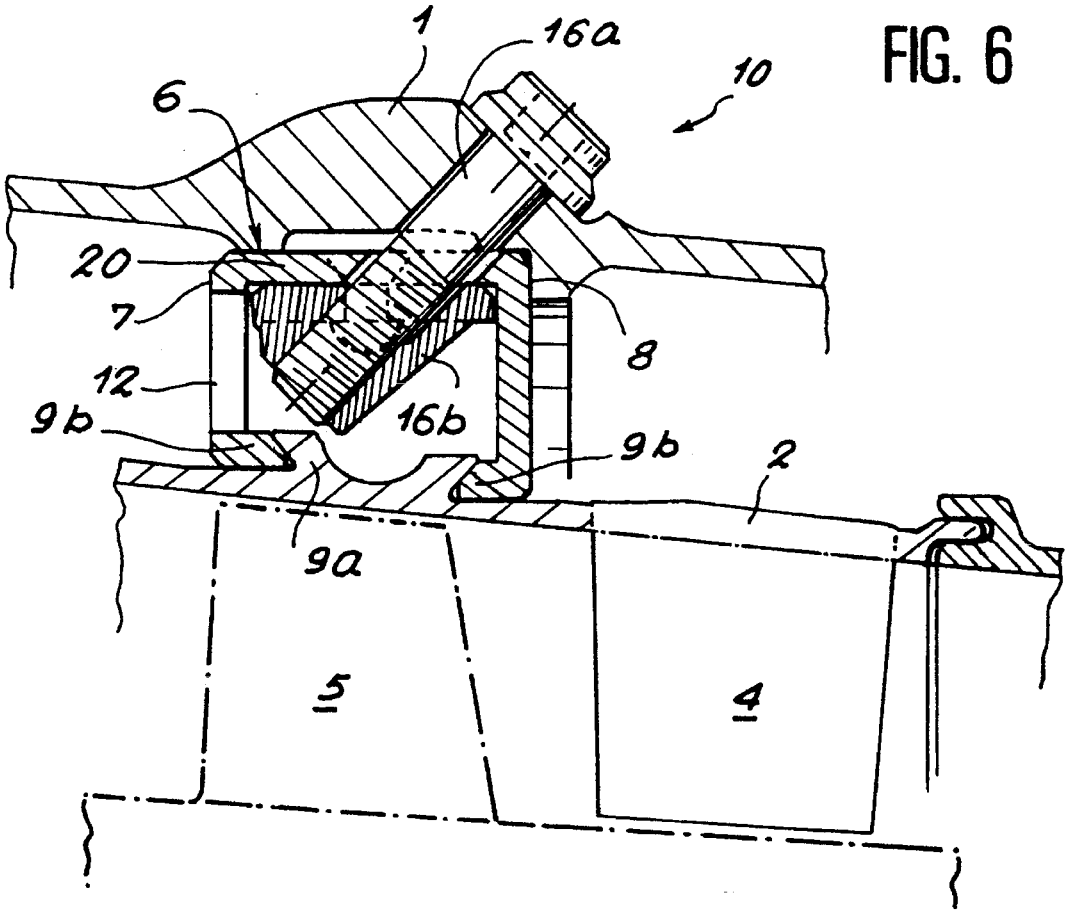
FIG. 6 represents according to an axial section a fixed point conforming to the first embodiment.

FIG. 6 shows an axial section of a fixed point. This fixed point 10 consists of a nut/screw system introduced into the housing 1 and ring 6 so as to render them integral. More specifically, this nut/screw system comprises a screw 16*a* introduced into the housing 1 and the core 20 of the ring 6 by a tap hole. A nut 16*b* introduced into the ring 6 via one of the recesses 12 of the upstream wing 7 ensures the fixing of the screw 16*a*. The screw 16*a* fixed into the nut 16*b* ensures that the ring 6 is rendered integral by its core 20 against the internal wall of the housing 1.

According to one embodiment of the invention, the nut is a bracket type nut whose brackets are fixed to the ring 6 by rivets 17*a* and 17*b* FIG. 4B.

According to the preferred embodiment of the invention, that is the embodiment shown on FIG. 6, the screw 16*a* is introduced into the housing 1 and the ring 6 with a longitudinal inclination, the nut 16*b* having a shape adapted in such a way so as to receive the slanted screw 16*a* while having a solid support against the internal face of the core 20 of the ring 6.

According to another embodiment of the invention, as shown on FIG. 7, the means for hooking the ferrule 2 with the ring 6 consist of a notch 30*b* made in each ferrule element 2 and a heel 30*a* made by the internal ends of the downstream wing 8 and upstream 7 wing of the ring sectors. Also, the integral rendering without play of each ring sector with the housing 1 is accomplished with the aid of a convex screw 32 introduced radially into the housing 1 and the ring. This screw is introduced into a conical nut 34 whose base, directed towards the ferrule, is in contact with the internal faces of the upstream and downstream wings. A crescent 36 is machined on the outer face of each ferrule element. Also, when the screw 32 is tightened, its convex end takes support in the crescent 36, the nut 34 rises and, via its conicity, distances the ring sector, thus embodying integralization without play between the ferrule element 2 and the ring sector 6.

Also at each sector end, the conical nut 34 is horseback-positioned on two sectors, thus enabling the sectors to slide with respect to the rings according to the heat variations.

Figure 8:
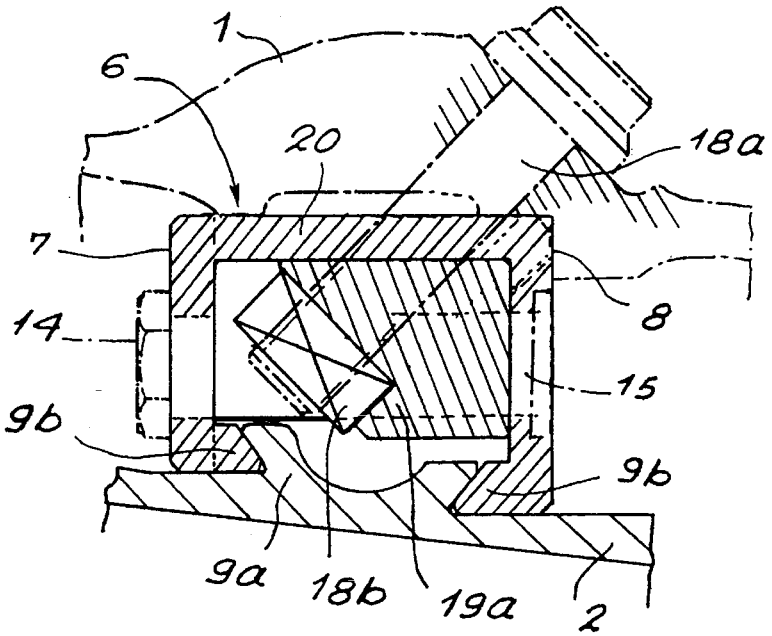
FIG. 8 shows an axial section of a sliding support linking the ring sector and housing in accordance with the first embodiment.

FIG. 8 shows an axial section of a sliding support. This sliding support 11 consists of a nut/screw system in which the nut is able to move on support pieces. More specificaly, this nut/screw system comprises a screw 18*a* introduced into the housing 1 and the projection of the sole 18*b*. This sole is formed of a base and a projection situated in the middle of the base. An opening 21 is made in the core 20 of the ring 6 and is sufficiently large so as to allow for the passage of the projection of the sole 18*b* which may then be in contact with the internal wall of the housing 1.

A nut 18*c* ensures that the screw 18*a* is fixed in the sole 18*b*. The base of the sole 18*b* is in support of two support pieces, only one of said pieces 19*a* being visible on FIG. 8. With the projection of the sole 18*b* traversing the opening 21 of the core 20 and the base of said sole 18*b* being able to slide on the support pieces, it is possible to have a circumferential play of the ring 6 with respect to the housing 1. These sliding supports 11 thus permit the movement of the ring 6 and thus of the ferrule 2 according to the heat variations.

According to the preferred embodiment of the invention, the support piece 19*a* and all the support pieces in the ring 6 are kept integral with the ring by chucking means 14, 15 which traverse said support pieces at their external ends.

Figure 9:
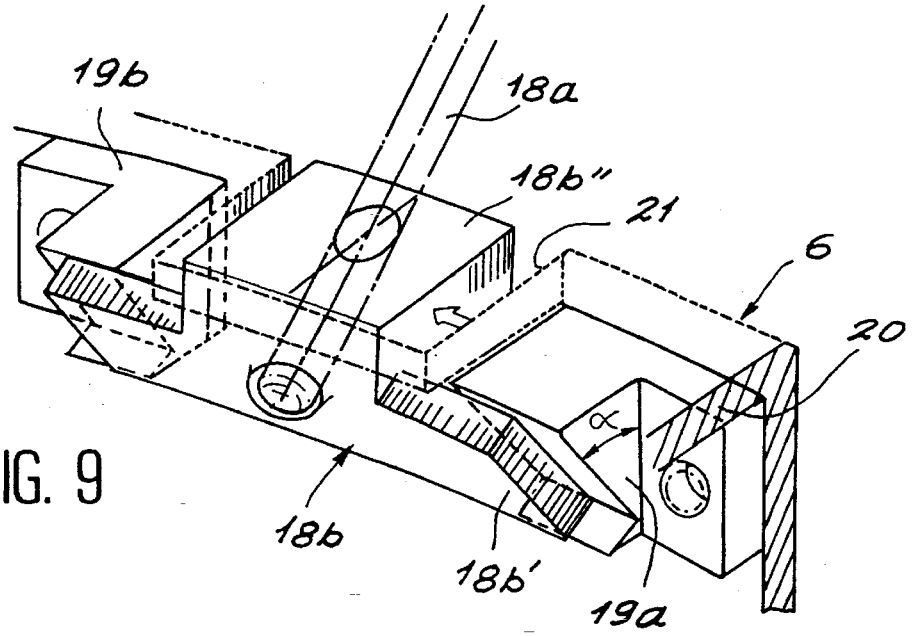
FIG. 9 is a perspective view of the support pieces and the sole forming the sliding support of FIG. 8.

FIG. 9 shows a perspective view of the support pieces and the sole of a sliding support. This figure shows the support pieces 19*a* and 19*b* having a wall slanted at 45° with respect to a radial direction on which the base 18*b*' of the sole 18*b* slides.

This figure also shows the projection 18*b*" of the sole 18*b* introduced into the opening 21. An arrow shows the play between the projection 18*b*" and the core 20 of the ring 6. In addition, the figure diagrammatically shows the screw 18*a* inserted in the projection 18*b*" and fixed by the nut 18*c*.

Figure 10:
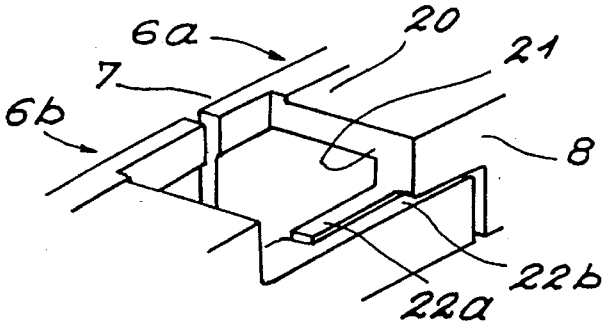
FIG. 10 shows a perspective view of the joining point between two ring sectors of FIG. 2.

FIG. 10 is a perspective view of the junction point between two ring sectors 6*a* and 6*b*. This junction point is made in the middle of an opening partly machined 21 in the core 20 of the ring sector 6*a* and partly in the core 20 of the ring sector 6*b*.

In addition, the downstream wing 8 of the ring sector 6*b* comprises a machined prologation bracket 22*b* in said downstream wing 8; the downstream wing 8 of the ring sector 6*a* comprises a prolongation bracket 22*a* symmetrical with the bracket 22*b* and the brackets 22*a* and 22*b* are complementary so as to be mutually nested inside each other. This juntion point of the ring sectors ensures, via the covering made to the downstream wings, imperviousness of the ring.

FIGS. 11 to 14 show the means for controlling the plays between the stator and rotor according to a second embodiment of the invention.

As the play controlling means conforming to this second embodiment are mounted on a housing almost identical to the one on which the controlling means of the first embodiment are mounted, it has not been considered necessary to add another general view of the high pressure compressor. Thus, reference needs to be made to FIG. 1 for a general description of the housing 1 and the ferrule elements 2 of the compressor.

FIG. 11 shows a partial view of this housing 1 and the ferrule 2 rendered integral by a fixed point and sliding supports. In greater detail, this figure shows a housing portion 1 and a ferrule element 2*d* joined to its two adjacent ferrule elements 2*e* and 2*f*. This figure also shows the means to control the plays between the stator and rotor. These means consist of a combination of a fixed point 10*d* and sliding supports lie and 11*f* making it possible to render each ferrule element 2*d*, 2*e* or 2*f* integral with the housing 1 while providing it with circumferential flexibility.

The ferrule element 2*d*, like all the other ferrule elements of the compressor, is thus secured at its center to the housing 1 by a fixed point 10*d* formed, as for the fixed point of FIG. 6, of a screw/nut system. More specifically, this screw/nut system comprises a screw 16*d* introduced into the housing 1 by a tap hole. A nut 16*e* introduced between the ferrule element 2*d* and the housing 1 and secured to said ferrule element 2*d* ensures fixing of the screw 16*d*. The screw 16*d*, once fixed in the nut 16*e*, ensures that the ferrule element 2*d* with no play is rendered integral against the internal wall of the housing 1.

According to one embodiment of the invention, the nut 16*e* is of the bracket type nut whose brackets are secured to the ferrule element 2*d* by rivets.

The sliding supports 11*f* and lie are situated symmetrically with respect to the fixed point 10*d*. They are each situated at the joining point of two ferrule elements. This embodiment is able to provide the ferrule 2 with circumferentuial flexibility with respect to the housing obtained by using the plays between the various ferrule elements 2.

FIG. 11 shows that the sliding support 11*f* is thus positioned horseback-mounted on the ferrule elements 2*d* and 2*f* and the sliding support 11*e* is horseback-mounted on the ferrule elements 2*e* and 2*d*.

More specifically, the sliding support 11*f* comprises two screws 40*a* and 40*b* introduced into the housing 1 by two separate tap holes and is fixed in a double floating nut 42. This floating nut 42 includes a sole 42*a* having two threaded holes in which the two screws 40*a* and 40*b* are screwed. This sole 42*a* is fitted with two lateral sliding brackets 42*b* and 42*c* each supported by a support piece 44*b* and 44*c* respectively.

FIG. 12 shows a perspective view of the floating double nut 42 with its sole 42*a* fitted with sliding brackets 42*b* and 42*c*. This figure also shows the two threaded holes 42*d* and 42*e* in which the screws 40*a* and 40*b* are introduced.

This figure also shows the support pieces 44*b* and 44*c* each comprising a notch 44*a* supporting the sliding brackets 42*b* and 42*c*. Each of these support pieces is integral with one of the ferrule elements. They can be secured there by means of soldering.

As can be seen on this figure, these sliding brackets 42*b* and 42*c* have a slightly curved shape at their free end so as to ensure they do not come out of the notches 44*a*.

Thus, when the ferrule elements expand on account of thermic effects, the sliding pieces integral with these ferrule elements slide along the sliding brackets of the floating nut, thus modifying the play between the ferrule elements.

Nevertheless, it needs to be stated that, as in the first embodiment of the invention, the screws of the fixed points and the screw of the sliding supports are positioned at an angle of about 45° with respect to the surface of the housing 1.

Figure 13:
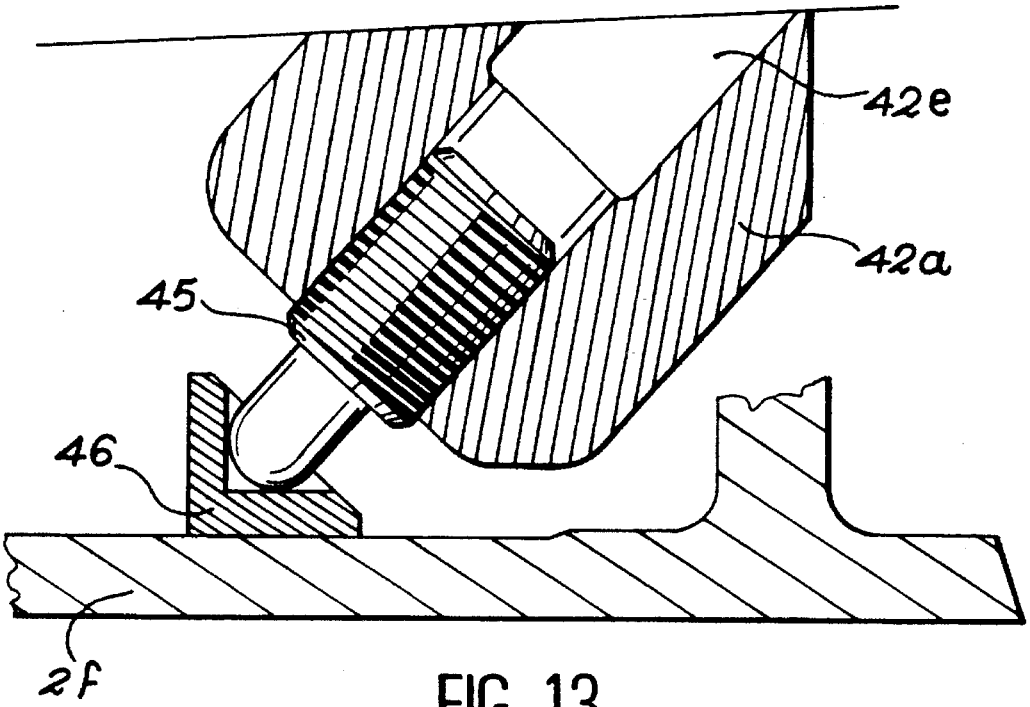

FIG. 13 shows one portion of the sole 42*a* of a double floating nut 42 so as to show the operation for mounting the sliding support 11*f*.

In addition, this figure shows one portion of the ferrule element 2*f* to which a placing support 46 is secured. According to the embodiment shown on FIG. 13, this support 46 is a sheet metal member shaped in the form of a V soldered onto the ferrule element 2*f*.

This support 46 is used for mounting the sliding support. In order to do this, a tooling screw 45 is introduced into the hole 42*e*, that is a headless screw shorter than the definitive screw 40*b*. This tooling screw 45 is thus introduced into the hole 42*e* until it is in support against the support 46 so as to keep the floating nut 42 fixed with respect to the ferrule element. This screw 45 is then embedded in the sole 42*a*, which makes it possible to position the housing 1 around the ferrule without being damaged by the presence of screw heads, such as those of the screws 40*a* and 40*b*.

When the housing 1 is correctly positioned, the screw 40*a* is introduced into the second hole 42*d* of the sole 42*a* so as to keep the housing in the selected position.

The tooling screw 45 may then be removed and replaced by the definitive screw 40*b*.

Figure 14:
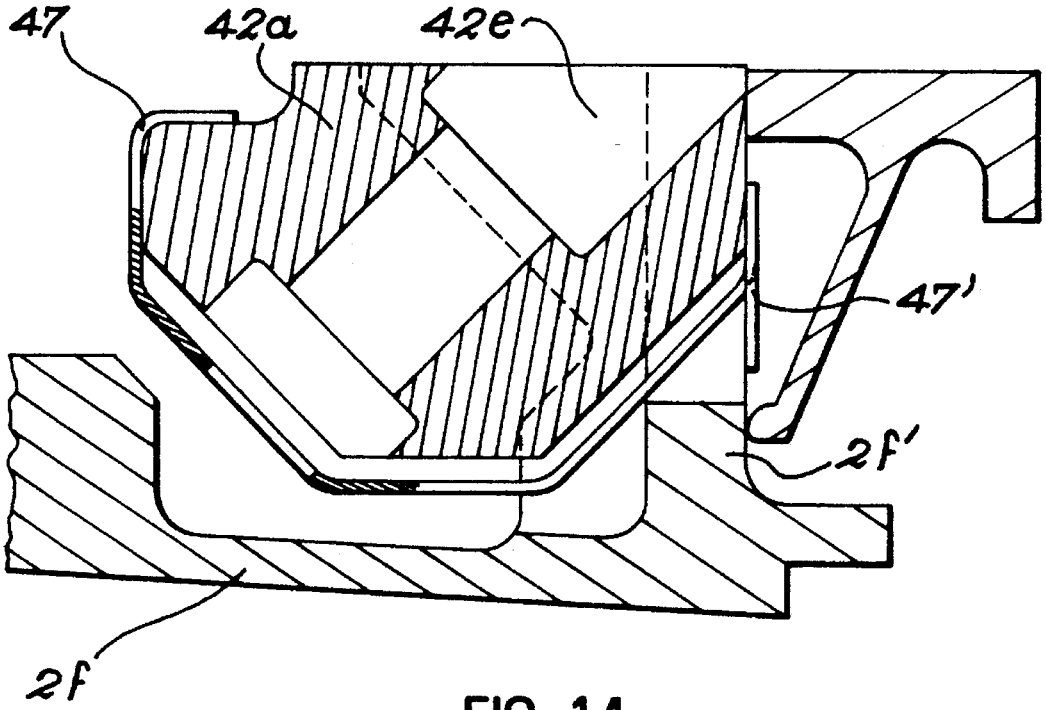

FIG. 14 shows a second method for mounting the sliding support 11*f* in which the sole 42*a* is kept in a fixed position with respect to the ferrule element 2*f* by means of a staple 47. This staple 47 is secured via its end 47' to the radial wall 2*f* of the ferrule element and partly surrounds the sole 42*a* so as to keep it solidly against this wall 2*f*.

In addition, except for the mode for keeping the floating nut on the ferrule, the second technique for mounting the sliding support remains identical to the first technique shown on FIG. 13 and described earlier and thus shall not be described again.

The second embodiment of the invention as described above provides the ferrule with circumferential flexibility via the sliding of the ferrule elements with respect to the housing 1 by means of the sliding supports.

In addition, it permits relatively fast easy mounting and reliable dismantling without any risk of jamming as the nuts are fixed temporarily.

Obviously, numerous modifications and variations of the present invention are possible in light of the above teachings. It is therefore to be understood that within the scope of the appended claims, the invention may be practiced otherwise than as specifically described herein.

What is claimed is:

1. A turbine engine comprising:

a ferrule formed of a plurality of ferrule elements in the shape of circular sectors each bearing fixed vanes on one internal face thereof, a circular housing surrounding the ferrule, wherein each ferrule element is integrally connected with the housing at a fixed point by a securing device and at least two sliding supports situated respectively on both sides circumferentially of the secured device so as to provide the ferrule element with circumferential flexibility;

a support ring housed between the housing and the ferrule and including a plurality of circular ring sectors each secured to the housing at a fixed point by a securing member and a sliding support, said ring sectors having a U-shaped section with an opening directed towards the ferrule, each ferrule element comprising a hooking member positioned inside at least one ring sector so as to integrally connect said ring sector and the ferrule element; and a support chuck located on both sides of each ring sector so as to make said ring sector integral with the member hooking the ring sector to the ferrule element.

2. A turbine according to claim 1, wherein each ring sector comprises one upstream wing and one downstream wing, each of said upstream and downstream wings including first recesses radially open towards the ferrule and providing said ring sector with circumferential flexibility.

3. A turbine according to claim 1, wherein each ring sector comprises on upstream wing and one downstream wing, said upstream wing including second recesses.

4. A turbine according to claim 1, wherein the chuck comprise a screw and a conical nut introduced inside the ring sector wherein said screw and conical nut are movable apart when the screw is introduced inside the ring sector and wherein the base of said nut supports internal faces of the ring sector.

5. A turbine according to claim 2, wherein the hooking member, together with ends of the front and downstream wings of the ring sector into which the hooking member is introduced, form a dovetail assembly.

6. A turbine according to claim 3, wherein each fixed point device comprises a nut and screw assembly ensuring that a ring sector is rendered integral with the housing without play, the nut being introduced inside the ring via the second recesses and disposed in support of one internal face of the core of the ring sector.

7. A turbine according to claim 6, wherein the screw is introduced into the ring sector at an angle of inclination of substantially 45° with respect to a radial direction.

8. A turbine according to claim 6, wherein the screw is introduced radially into the ring sector and the nut has a conical shape with a base directed towards the ferrule.

9. A turbine according to claim 1, wherein each sliding support device comprises:

a screw surmounted by a projection which is introduced into the ring sector via an opening formed in the core of said ring sector;

a sole surmounted by a projection which is pierced with a hole comprising on the wall a thread pitch receiving said screw and which traverses at least partly the opening of the core so as to be in contact with the housing;

two support pieces disposed on both sides of the hole of the sole and secured to the ring sector so as to enable the sole to slide on the support pieces.

10. A turbine according to claim 9, wherein, when the screw is introduced into the ring sector with a longitudinal inclination with an angle $\alpha$, the support pieces comprise a slanted surface with an angle $\alpha$ with respect to a radial direction.

11. A turbine according to claim 2, which comprises sealing plates wherein the first recesses of the downstream wing are closed by said sealing plates.

12. A turbine according to claim 11, wherein the downstream wing of each ring sector comprises around the first recesses grooves in which the sealing plates are positioned.

13. A turbine according to claim 2, wherein each downstream wing of a ring sector comprises at one end a first prolongation bracket and, at another end, a second prolongation bracket ensuring nesting with covering of said ring sector in the adjacent ring sectors.

14. A turbine according to claim 1, wherein each sliding support device is positioned on two ferrule elements so as to be kept integral therewith.

15. A turbine according to claim 14, wherein each sliding support device comprises:

two screws traversing the housing;

a sole situated at a junction point of the two ferrule elements between the housing and said ferrule elements, said sole being including two threaded holes formed therein so as to received the two screws and which includes sliding brackets disposed on both sides of the holes; and two support pieces situated on both sides of the holes of the sole and each secured to one of the ferrule elements so as to slide along the sliding brackets of the sole.

* * * * *